US011707762B2

(12) United States Patent
Carstens et al.

(10) Patent No.: US 11,707,762 B2
(45) Date of Patent: Jul. 25, 2023

(54) ROTARY DISPENSING TANK

(71) Applicant: Alfons Haar, Inc., Springboro, OH (US)

(72) Inventors: Aaron Emmanuel Carstens, Centerville, OH (US); Stephen B. Turner, Centerville, OH (US)

(73) Assignee: Alfons Haar, Inc., Springboro, OH (US)

( * ) Notice: Subject to any disclaimer, the term of this patent is extended or adjusted under 35 U.S.C. 154(b) by 0 days.

(21) Appl. No.: 17/645,349

(22) Filed: Dec. 21, 2021

(65) Prior Publication Data

US 2023/0191441 A1 Jun. 22, 2023

(51) Int. Cl.
*B05B 3/02* (2006.01)
*B05C 11/10* (2006.01)
*B05C 11/02* (2006.01)

(52) U.S. Cl.
CPC ..... *B05C 11/1002* (2013.01); *B05C 11/02* (2013.01)

(58) Field of Classification Search
CPC ..... B05C 11/1002; B05C 11/02; B05C 5/208; B05B 3/02; B05B 13/0242; B05B 13/0447; B05B 3/026; B05B 13/0228; B65B 3/04
See application file for complete search history.

(56) References Cited

U.S. PATENT DOCUMENTS 2,761,605 A 9/1956 Pahl et al.
3,517,476 A 6/1970 Bowen
3,818,807 A 6/1974 Semple
3,852,095 A 12/1974 Hogstrom
4,221,102 A 9/1980 Lang et al.
4,262,629 A 4/1981 Mcconnellogue et al.
4,274,456 A 6/1981 Huffman
4,840,138 A 6/1989 Stirbis
4,879,137 A 11/1989 Behr et al.
5,215,587 A 6/1993 Mcconnellogue et al.
5,340,289 A 8/1994 Konieczynski et al.
5,533,853 A 7/1996 Wu
5,564,877 A 10/1996 Hamilton
5,823,177 A 10/1998 Whitehead
5,947,337 A * 9/1999 Worth ..... B05C 11/101 222/394
6,113,333 A 9/2000 Rutledge et al.
7,134,824 B2 11/2006 Garcia
7,179,333 B2 2/2007 Woolley et al.
(Continued)

FOREIGN PATENT DOCUMENTS

JP 9066485 A 3/1997
KR 1020069016560 A 2/2006

OTHER PUBLICATIONS

International Search Report and Written Opinion of the International Searching Authority dated Apr. 24, 2023; International Application No. PCT/US2022/051637; European Patent Office; Rijswijk, Netherlands.

*Primary Examiner* — Vishal Pancholi
*Assistant Examiner* — Robert K Nichols, II
(74) *Attorney, Agent, or Firm* — Stevens & Showalter LLP

(57) ABSTRACT

A dispensing system for a rotary dispensing machine includes a tank, a fill tube, and a piston that moves along the fill tube and defines an air chamber and a fluid chamber within the tank. The tank is rotatable relative to the fill tube. A fluid is dispensed from the fluid chamber of the tank through at least one outlet formed in the tank.

20 Claims, 5 Drawing Sheets

(56) References Cited

U.S. PATENT DOCUMENTS

| | | | | |
|---|---|---|---|---|
| 7,592,033 | B2 | 9/2009 | Buckley et al. | |
| 8,261,631 | B2 | 9/2012 | Weil et al. | |
| 8,499,983 | B2 * | 8/2013 | Conrardy | F02K 9/605 222/394 |
| 11,484,895 | B2 * | 11/2022 | Zumberger | B05B 3/02 |
| 2009/0206111 | A1 | 8/2009 | Conrardy et al. | |
| 2013/0062431 | A1 | 3/2013 | Garcia | |
| 2013/0322989 | A1 | 12/2013 | Garcia | |
| 2016/0008842 | A1 | 1/2016 | Dobbin | |
| 2017/0101303 | A1 | 4/2017 | Tornesch et al. | |

* cited by examiner

ROTARY DISPENSING TANK

FIELD OF THE INVENTION

The present invention relates to a dispensing system for a rotary dispensing machine.

BACKGROUND OF THE INVENTION

It is common in can assembly operations to dispense a sealant material into an annular groove of a can lid for attachment of the lid to the open end of a can body. Typically, this is done through the use of a rotary can end lining machine where the can lids are advanced in rapid succession onto continuously rotating chuck(s).

SUMMARY OF THE INVENTION

In accordance with an aspect of the invention, a dispensing system for a rotary dispensing machine is provided where the dispensing system has a table rotatable about a central axis of rotation. A tank is mounted to the table and includes at least one fluid outlet port for supplying a fluid from the tank. A fill tube extends through an upper end of the tank where the tank is rotatable relative to the fill tube. A piston is provided within the tank and movable along the fill tube. The piston defines an air chamber in an upper portion on the tank and a fluid chamber in a lower portion of the tank.

The dispensing system may further comprise at least one seal supported on the piston for engagement with an inner surface of a sidewall of the tank.

The at least one seal may be a resilient self-energizing seal.

The dispensing system may further comprise a labyrinth seal system extending around the piston comprising upper and lower circumferential self-energizing seals formed of a resilient material for engagement with the inner surface of the sidewall, and a guide band located on the piston between the upper and lower self-energizing circumferential seals.

The dispensing system may further comprise at least one seal supported on the piston for engagement with an outer surface of the fill tube.

The at least one seal may be a resilient self-energizing seal.

The dispensing system may further comprise a labyrinth seal system comprising upper and lower inner self-energizing seals located in respective grooves formed in the piston and formed of a resilient material for engagement with the outer surface of the fill tube, and a guide band located between the upper and lower self-energizing inner seals.

The fill tube may be non-rotatably supported and the piston may be rotatable relative to the fill tube.

The dispensing system may further comprise a sensor structure for detecting a position of the piston within the tank.

In accordance with another aspect of the invention, a dispensing system for a rotary dispensing machine is provided where the dispensing system has a table rotatable about a central axis of rotation. A rotatable tank is mounted to the table and has an upper end, a lower end, and a sidewall extending between the upper and lower ends. A fill tube extends through the upper end of the tank and has an upper end located outside of the tank and a lower end located within the tank. A piston is located within the tank where the fill tube extends through the piston and the piston being movable relative to the fill tube and the tank. One or more outlet ports are formed in the tank for dispensing a flowable material from an area defined between the piston and the lower end of the tank.

The dispensing system may further comprise a non-rotatable housing located above the upper end of the tank for supporting the fill tube, the housing including an air supply port for supplying air to an area defined between the piston and the upper end of the tank.

The dispensing system may further comprise a bearing positioned within the housing and around the fill tube, and an air passage defined between the fill tube and the housing for receiving air from the air supply port.

The dispensing system may further comprise a seal defined between an outer surface of the fill tube and the housing.

The dispensing system may further comprise an outer seal structure supported on an outer circumference of the piston, the outer seal structure having a normal position out of sealing engagement with an inner surface of the tank sidewall and having a pressure actuated self-energizing position in sealing engagement with the inner surface of the tank sidewall.

The outer seal structure may comprise an upper self-energizing circumferential seal located near an upper end of the piston and a lower self-energizing circumferential seal located near a lower end of the piston.

The upper and lower self-energizing circumferential seals may comprise cup seals actuated by pressure above and below the piston biasing the circumferential seals into sealing engagement with the inner surface of the tank sidewall.

The dispensing system may further comprise a guide band located on the outer circumference of the piston between the upper and lower self-energizing circumferential seals, the guide band having an outer surface in sealing relationship adjacent to the inner surface of the tank sidewall to form a labyrinth seal system with the upper and lower circumferential seals.

The guide band may comprise a magnetic material, and the dispensing system may further comprise at least one sensor located external to the tank for sensing the magnetic material in the guide band to determine a vertical position of the piston.

The dispensing system may further comprise a fluid level sensor supported with the tank for detecting a position of the piston within the tank, wherein the fluid level sensor comprises at least one of an optical sensor or a magnetic sensor.

The dispensing system may further comprise an inner seal structure located in a circumferential groove formed in the piston, the inner seal structure having a normal position out of sealing engagement with an outer surface of the fill tube and having a resilient self-energizing pressure actuated position in sealing engagement with the outer surface of the fill tube.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

The following text sets forth a broad description of one or more embodiments of the present disclosure. The description is to be construed as exemplary only and does not describe every possible embodiment since describing every possible embodiment would be impractical, if not impossible, and it will be understood that any feature, characteristic, component, composition, ingredient, product, step or methodology described herein may be deleted, combined with or substituted for, in whole or part, any other feature, characteristic, component, composition, ingredient, product, step or methodology described herein. It should be understood that multiple combinations of the embodiments described and shown are contemplated and that a particular focus on one embodiment does not preclude its inclusion in a combination of other described embodiments. Numerous alternative embodiments could also be implemented, using either current technology or technology developed after the filing date of this patent, which would still fall within the scope of the claims.

Figure 1:
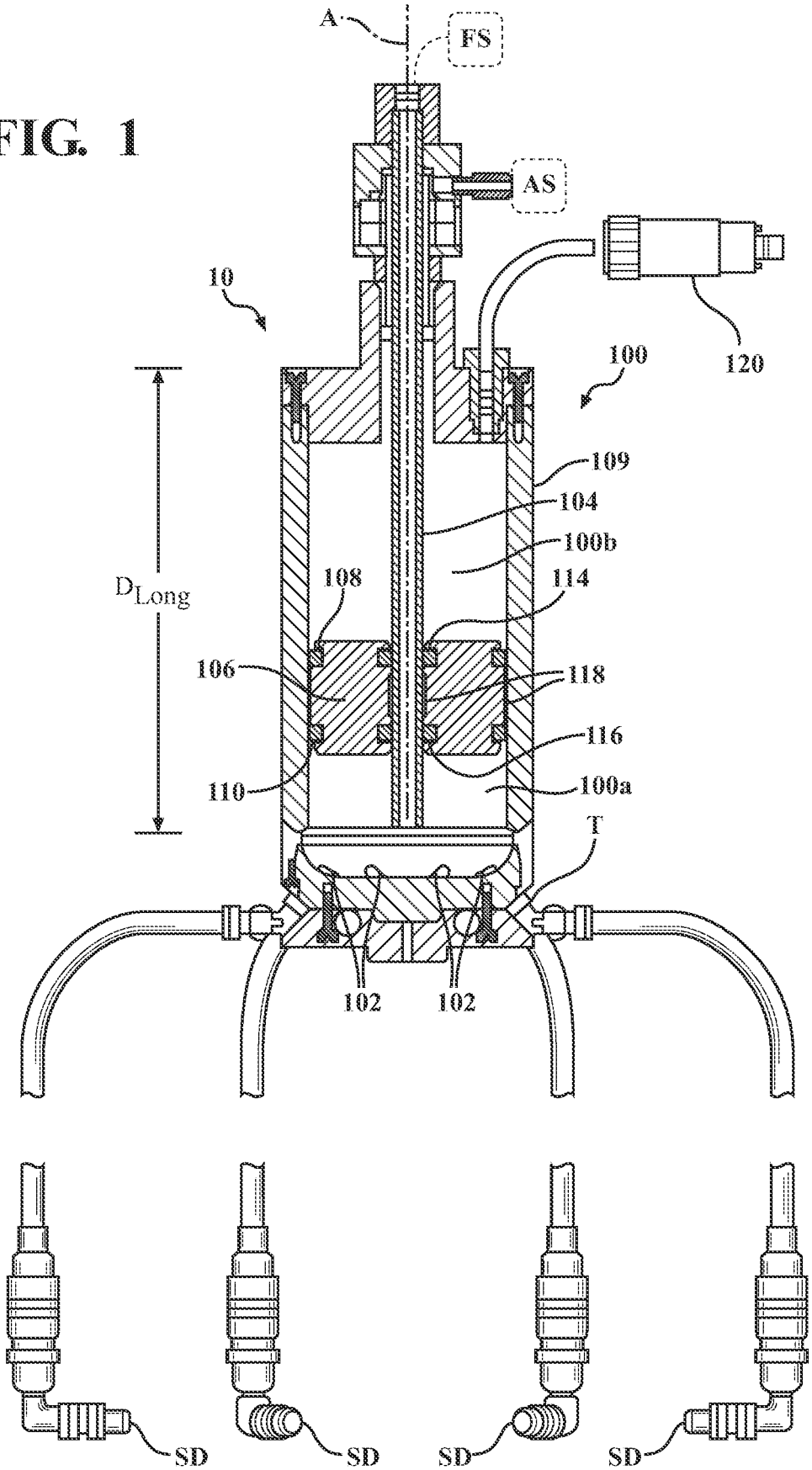
FIG. 1 is a cross-sectional view of a dispensing system in accordance with principles of the present disclosure.

Referring to FIG. 1, a dispensing system 10 according to an embodiment is shown. The dispensing system 10 includes a supply tank 100 that is supported for rotation with a chuck table T. A lower end 1000*a* of the supply tank 100 includes a plurality of fluid outlet ports 102 for supplying a flowable material comprising a fluid compound, e.g., a sealant, to a plurality of spray devices SD, as will be discussed below. The dispensing system 10 further includes a fill tube 104 that extends down into the supply tank 100 in a longitudinal direction $D_{Long}$ of the dispensing system 10. The fill tube 104 has a lower end 104*a* located within the supply tank 100 and an upper end 104*b* located outside the supply tank 100. The fluid compound, received from a fluid source FS, is supplied to the upper end 104*b* of the fill tube 104. The fluid compound then exits at the lower end 104*a* of the fill tube 104 into a lower fluid chamber 100*a* located within a lower portion of the supply tank 100. The fill tube 104 supports a piston 106 inside the supply tank 100, wherein the supply tank 100 and the piston 106 are rotatable about a central axis of rotation A of the dispensing system 10. The piston 106 is movable in the longitudinal direction $D_{Long}$ along the fill tube 104 and divides the interior of the supply tank 100 into the lower fluid chamber 100*a* below the piston 106 and an upper air chamber 100*b* above the piston 106.

Figure 2:
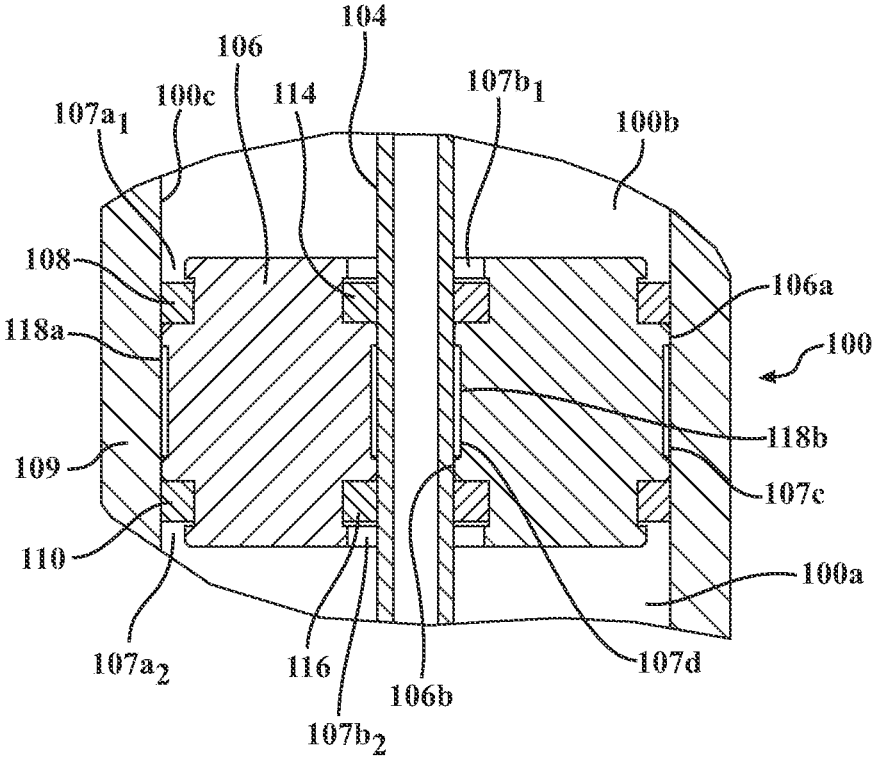
FIG. 2 is a cross-sectional view of a central portion of the system of FIG. 1.

Referring to FIG. 2, an outer surface 106*a* of the piston 106 includes upper and lower outer circumferential grooves 107*a*1, 107*a*2, which grooves 107*a*1, 107*a*2 receive respective circumferential upper and lower outer seals 108, 110 for sealing a gap between the outer surface 106*a* of the piston 106 and an inner surface 100*c* of a sidewall 109 of the supply tank 100. An inner surface 106*b* of the piston 106 includes upper and lower inner circumferential grooves 107*b*1, 107*b*2, which grooves 107*b*1, 107*b*2 receive respective circumferential upper and lower inner seals 114, 116 for sealing a gap between the inner surface 106*b* of the piston 106 and an outer surface 104*c* of the fill tube 104.

According to one exemplary embodiment, the seals 108, 110, 114, 116 may be resilient self-energizing seals, such as, for example, outward facing cup seals, and may be formed from a thermoplastic polymer, such as, for example, polyether ether ketone. As described in further detail below, the outer seals 108, 110 are normally out of contact with the sidewall 109 of the supply tank 100, and the inner seals 114, 116 are normally out of contact with the outer surface 104*c* of the fill tube 104. FIG. 2 shows the seals 108, 110, 114, 116 in dashed lines in an energized position.

The piston 106 also includes outer and inner circumferential guide bands 118*a*, 118*b* that are respectively positioned between the upper and lower seals 108, 110, 114, 116, wherein the outer guide band 118*a* is positioned in an outer groove 107*c* on the outer surface 106*a* of the piston 106 and the inner guide band 118*b* is positioned in an inner grove 107*d* on the inner surface 106*b* of the piston 106. The guide bands 118*a*, 118*b* may be formed from a polymer and at least the outer guide band 118*a* may comprise a magnetic material, such as, for example, metallic flakes embedded therein. The guide bands 118*a*, 118*b* create very thin air gaps between the guide bands 118*a*, 118*b* and the inner surface 100*c* of the supply tank sidewall 109 and the outer surface 104*c* of the fill tube 104, respectively. The guide bands 118*a*, 118*b* thus provide additional seals between the lower fluid chamber 100*a* and the upper air chamber 100*b*. The guide bands 118*a*, 118*b* preferably have a height of at least 0.5" such that the air gaps are sufficiently long enough to maximize sealing between the lower fluid chamber 100*a* and the upper air chamber 100*b*. According to one aspect, the inner and outer guide bands 118*a*, 118*b* may each have a unique minimum height, with the outer guide band 118*a* having a greater height than the inner guide band 118*b* since the diameter of the outer guide band 118*a* is greater than the diameter of the inner guide band 118*b*. For example, in one exemplary embodiment, the outer guide band 118*a* may have a height of at least about 1", and the inner guide band 118*b* may have a height of at least about 0.5". The minimum heights of the inner and outer guide bands 118*a*, 118*b* may be proportional to their diameters. As described in further detail below, when the seals 108, 110, 114, 116 are engaged with the inner surface 100*c* of the supply tank sidewall 109 and the outer surface 104*c* of the fill tube 104, the combination of the seals 108, 110, 114, 116 and the guide bands 118*a*, 118*b* creates a labyrinth sealing system.

Figure 3:
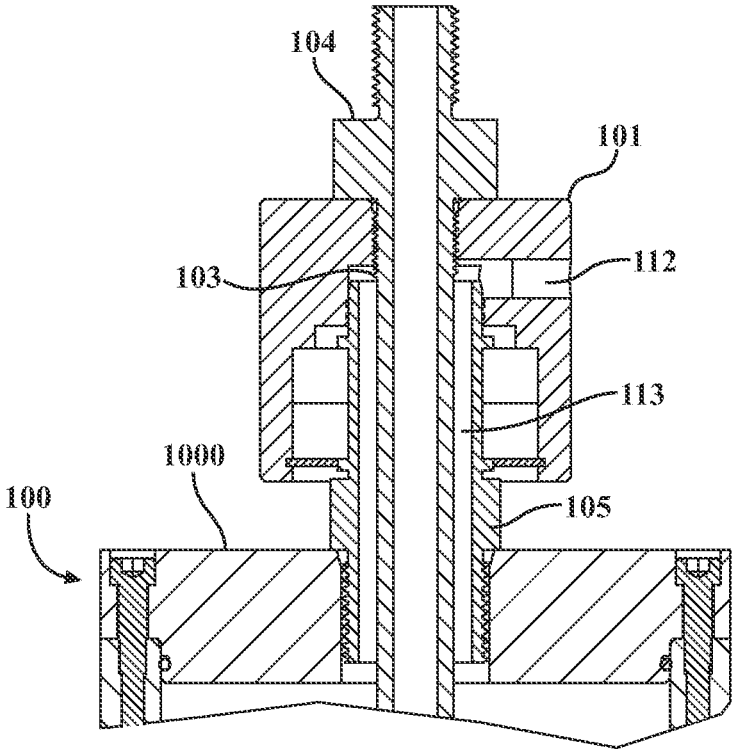
FIG. 3 is a cross-sectional view of an upper portion of the system of FIG. 1.

With reference now to FIG. 3, the dispensing system 10 includes a non-rotatable housing 101 located above an upper end 1000*b* of the supply tank 100. The housing 101 supports the fill tube 104 and is stationary along with the fill tube 104 relative to the rotatable supply tank 100. As shown in FIG. 3, the housing 101 includes an air supply port 112 that provides air from an air source AS (see FIG. 1) to the upper air chamber 100*b* of the supply tank 100, as described in further detail below. The air source AS may comprise a self-relieving regulator to control the air pressure in the upper air chamber 100*b*. An air passage 113 is defined between the housing 101 and the fill tube 104. The air passage 113 connects the air supply port 112 to the upper air chamber 100*b* for supplying air to the upper air chamber 100*b*.

The dispensing system 10 further comprises a rotary union including a bearing 103 that is positioned around the fill tube 104 within the stationary housing 101. The bearing 103 allows the supply tank 100 to rotate relative to the fill tube 104. A seal 105 is located between the housing 101 and the upper end 1000*b* of the supply tank 100 for sealing the upper air chamber 100*b*.

Figure 4:
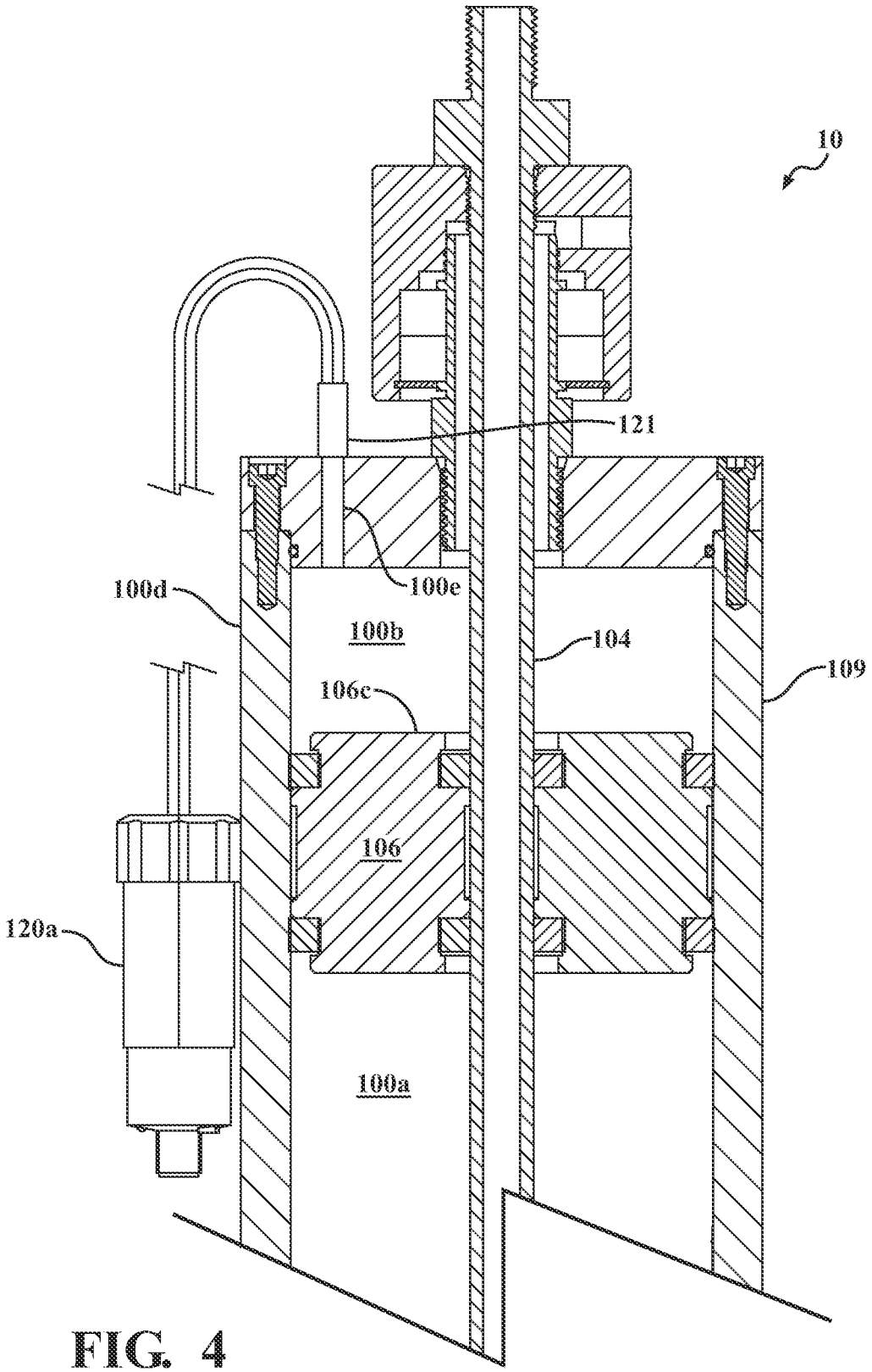
FIG. 4 is a cross-sectional view of the system of FIG. 1 equipped with an optical sensor in accordance with principles of the present disclosure.

Referring again to FIG. 1, the dispensing system 10 may include sensor structure 120 to monitor the position of the piston 106. According to one exemplary embodiment, FIG. 4 illustrates the sensor structure in the form of a fiber optic sensing device 120*a*. The fiber optic sensing device 120*a* is positioned on an outer surface 100*d* of the supply tank sidewall 109 and includes a sensing end 121 that is located within a slot 100*e* of the supply tank 100. As described in detail below, the fiber optic sensing device 120*a* is able to provide a continuous monitoring of the position of the piston 106 within the supply tank 100.

Figure 5:
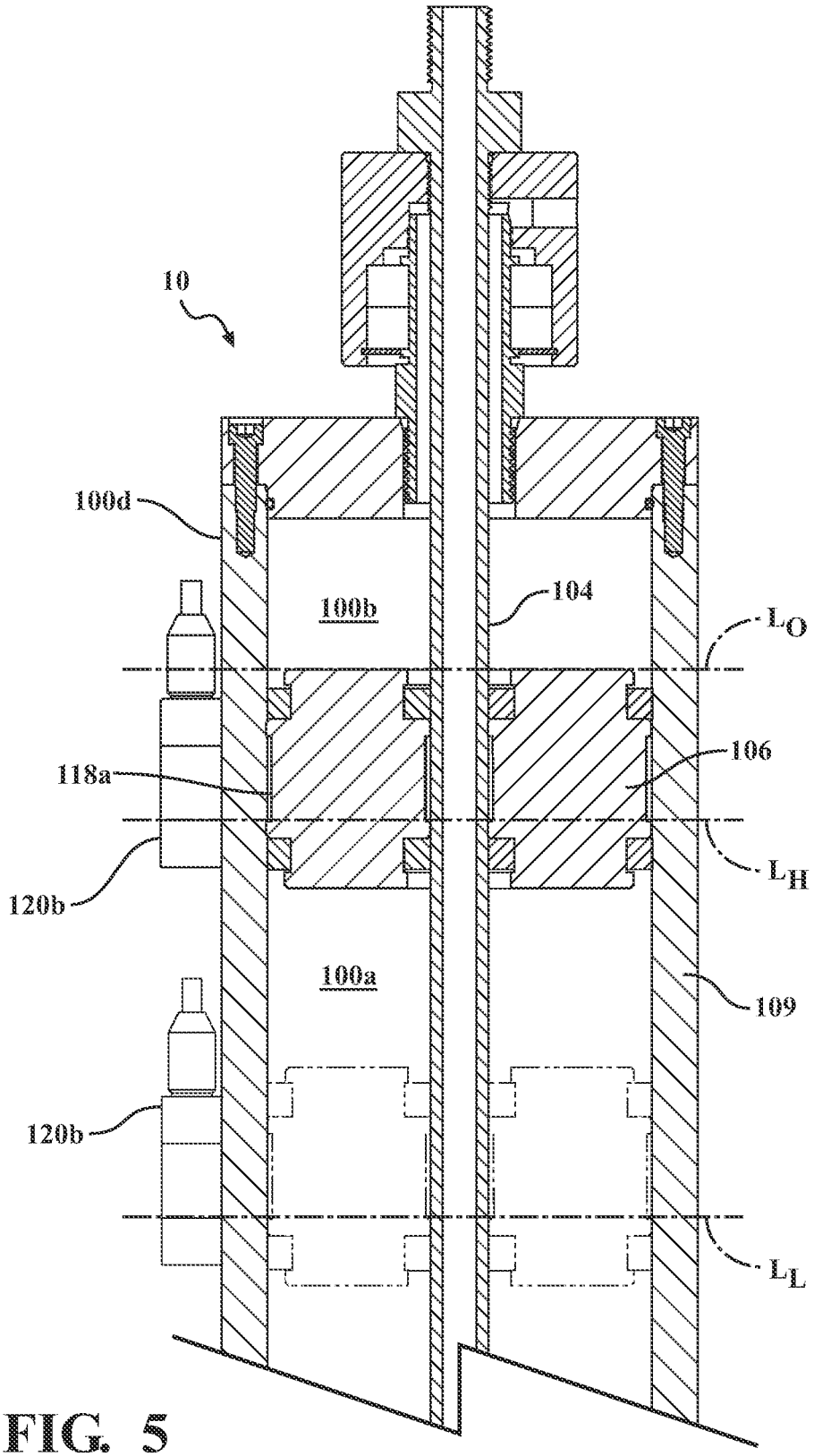
FIG. 5 is a cross-sectional view of the system of FIG. 1 equipped with a magnetic sensor in accordance with principles of the present disclosure.

According to another exemplary embodiment, FIG. 5 illustrates the sensor structure in the form of a set of magnetic field sensors 120*b*. Each magnetic field sensor 120*b* may be mounted on the outer surface 100*d* of the supply tank sidewall 109. As described in detail below, the magnetic field sensors 120*b* each provide discrete monitoring of a fixed point within the supply tank 100. Contemplated measurement locations for the magnetic field sensors 120*b* shown in FIG. 5 include a low fluid level location $L_L$, a high fluid level location $L_H$, and an overflow fluid level location $L_O$. Additional or fewer sensors 120*b* may be used as desired. One or more of the magnetic field sensors 120*b* may determine the vertical position of the piston 106 by sensing the outer guide band 118*a*, as will be discussed below.

Figure 6:
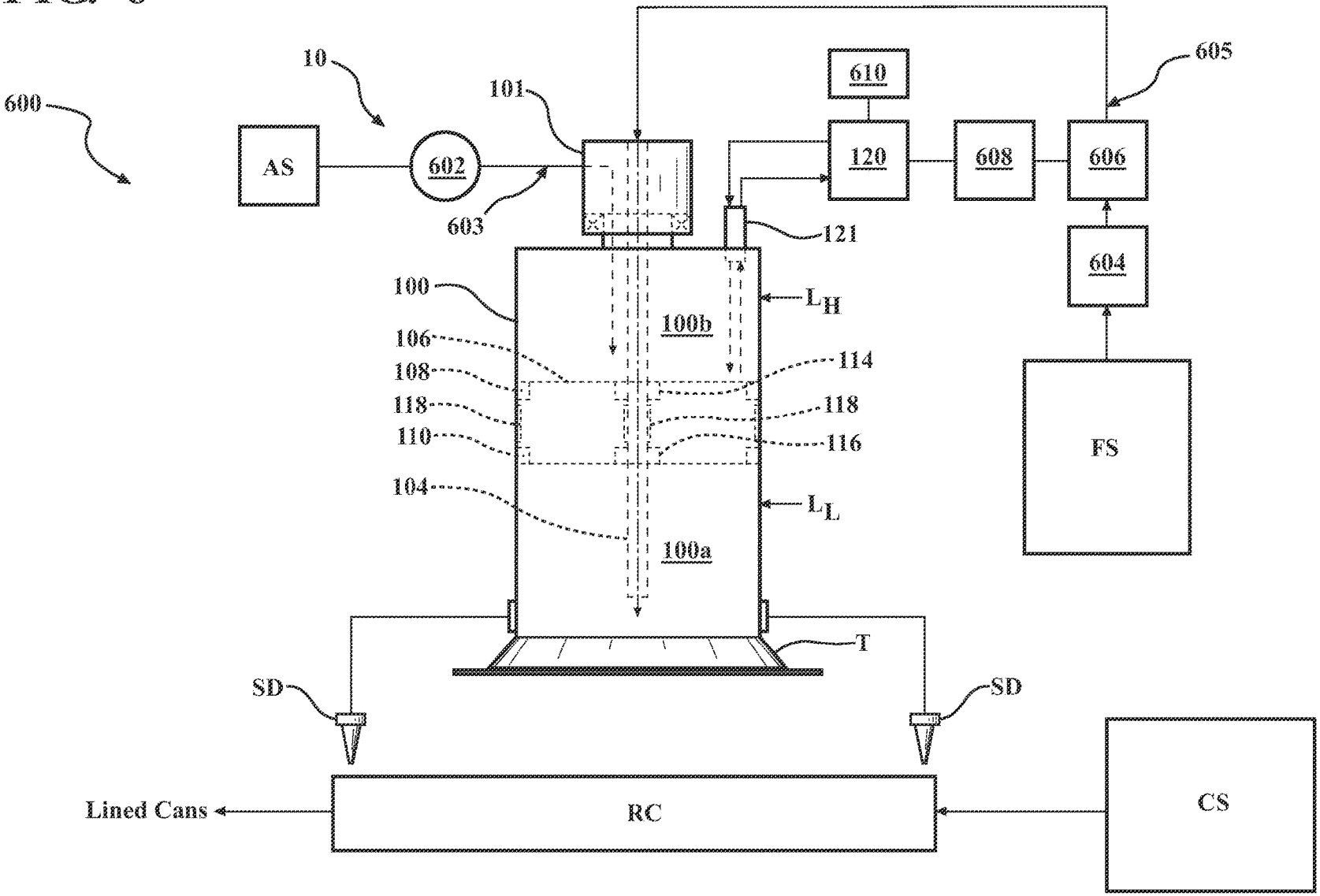
FIG. 6 is a schematic diagram of a rotary dispensing machine including the system of FIG. 1 in accordance with principles of the present disclosure.

In accordance with an embodiment, both types of sensors 120*a*, 120*b* may transmit data wirelessly. Alternatively, wires of the sensors 120*a*, 120*b* may terminate in a junction box, such as a ROTOCON Model MX-6 rotary contact manufactured by Meridian Laboratory (not shown) that may be located, for example, beneath the supply tank 100. With reference to FIG. 6, in one exemplary embodiment, the sensor(s) 120 may be powered by a 24 VDC power supply 610.

During operation of the dispensing system 10, the fluid compound is supplied from the fluid source FS to the lower fluid chamber 100*a* of the supply tank 100 through the fill tube 104. As the fluid chamber 100*a* fills with the fluid compound, i.e., as the volume of the fluid compound in the fluid chamber 100*a* increases, the piston 106 moves upwardly along the fill tube 104 in the longitudinal direction $D_{Long}$. As the piston 106 moves along the fill tube 104, the guide bands 118*a*, 118*b* help stabilize the piston 106 within the supply tank 100.

If equipped in the dispensing system 10, the sensor(s) 120 determine the location of the piston 106 in the supply tank 100, wherein the position of the piston 106 may be used to control the dispersal of fluid compound from the dispensing system 10 as will be described in more detail below.

In the embodiment including the fiber optic sensor 120*a*, the fiber optic sensor 120*a* may continuously monitor the location of the piston 106 by monitoring the distance between the sensing end 121 of the fiber optic sensor 120*a* and a top portion 106*c* of the piston 106. For example, the sensing end 121 may transmit light that is reflected off the top portion 106*c* of the piston 106 back to the sensing end 121, wherein the fiber optic sensing device 120*a* determines the position of the piston 106 based on the time of flight of the light. Thus, the fiber optic sensing device 120*a* is able to provide a continuous monitoring of the position of the piston 106 within the supply tank 100. Because the fiber optic sensing device is able to provide continuous monitoring, only one fiber optic sensing device 120*a* would be required to monitor the position of the piston 106.

In the embodiment including the plurality of magnetic field sensors 120*b*, each sensor 120*b* is able to detect a magnetic field given off by the outer guide band 118*a* when the piston 106 is near that specific sensor 120*b*. Since each magnetic field sensors 120*b* measures the position of the piston 106 at the specific position where the sensor 120*b* is located, multiple magnetic field sensors 120*b* may be used to monitor the movement of the piston 106 between various locations. The sensors 120*b* may be placed at specific locations on the outer surface 100*d* of the supply tank 100 that correspond to different fluid levels, for example, wherein the fluid is at a low level corresponding to the low fluid level location $L_L$, a high level corresponding to the high fluid level location $L_H$, or an overflow level corresponding to the overflow fluid level location $L_O$.

As the fluid is introduced into the supply tank 100 and the fluid pressure builds in the lower fluid chamber 100*a*, the lower outer and inner seals 110, 116 are respectively energized into sealing contact with the inner surface 100*c* of the supply tank sidewall 109 and the fill tube 104, thus creating seals to militate against fluid escaping from the lower fluid chamber 100*a* at these locations.

Similarly, as air is supplied to the upper air chamber 100*b* of the supply tank 100 from the air source AS through the air supply port 112 and the air passage 113, the air pressure builds in the upper air chamber 100*b*, causing the upper outer and inner seals 114, 116 to respectively energize into sealing contact with the inner surface 100*c* of the supply tank sidewall 109 and the fill tube 104, thus creating seals to militate against air escaping from the upper air chamber 100*b* at these locations.

In combination with the upper and lower seals 108, 110, 114, 116, the air gaps created by the guide bands 118*a*, 118*b* form a labyrinth seal system between the lower fluid chamber 100*a* and the upper air chamber 100*b*. Even while the upper and lower seals 108, 110, 114, 116 are not energized into contact with the inner surface 100*c* of the supply tank sidewall 109 and the fill tube 104 (e.g., when the pressures in the lower fluid chamber 100*a* and the upper air chamber 100*b* are below seal-energizing levels, which is defined as the pressure level at which the seals 108, 110, 114, 116 are not energized into contact with the respective inner surface 100*c* of the supply tank sidewall 109 and the fill tube 104), this labyrinth seal system militates against the leakage of fluid and air between the lower fluid chamber 100*a* and the upper air chamber 100*b*, as described in more detail below.

As the supply tank 100 rotates about the central axis of rotation A of the dispensing system 10, the engagement of the energized outer seals 108, 110 with the inner surface 100*c* of the supply tank sidewall 109 causes the piston 106 to rotate about the central axis of rotation A, i.e., the piston is rotationally carried by the rotating supply tank 100. The rotation of the piston 106 with the supply tank 100 reduces wear on the outer seals 108, 110 due to a reduction in friction, as compared to a situation where one of the supply tank 100 or the piston 106 rotates relative to the other. This reduction in friction and associated heat is believed to increase the useable life of the seals 108, 110.

The fluid compound is distributed from the outlet ports 102 of the supply tank 100 to the plurality of spray devices SD, where the fluid may be sprayed onto cans that are provided onto continuously rotating chuck(s) RC (See FIG. 6) underneath the supply tank 100. The reduction in volume of the fluid compound in the lower fluid chamber 100*a* causes the piston 106 to move downwardly along the fill tube 104 in the longitudinal direction $D_{Long}$. As noted above, the location of the piston 106 may be monitored using the sensor(s) 120, wherein the location of the piston 106 may be used to determine when additional fluid compound needs to be supplied from the fluid source FS to maintain fluid pressure in the lower fluid chamber 100*a*. Additionally, as the piston 106 moves along the fill tube 104, the pressure in the upper air chamber 100*b* changes, i.e., as the piston 106 moves up, the area of the upper air chamber 100*b* decreases, which increases pressure in the upper air chamber 100*b*, and as the piston 106 moves down, the area of the upper air chamber 100*b* increases, which decreases pressure in the upper air chamber 100*b*. The self-relieving regulator is operated to introduce air into the upper air chamber 100*b* as the pressure becomes too low, and also expels air from the upper air chamber 100*b* if the pressure becomes too high. Maintaining the pressure within the upper air chamber 100*b* controls the distribution of compound fluid out of the outlet ports 102. This precise control of the discharge of the fluid compound from the dispensing system 10 decreases waste and operating costs.

Referring to FIG. 6, an exemplary embodiment of a rotary dispensing machine 600, which includes the dispensing system 10 disclosed herein, is shown. As discussed above, the dispensing system 10 is positioned on a chuck table T to support rotation of the supply tank 100. Air and fluid compound are supplied to the dispensing system 10 respectively from an air source AS and a fluid source FS to maintain pressure within the chamber 100. A pressure gauge 602 is provided in an air supply line 603 extending from the air source AS to the dispensing system 10. The pressure gauge 602 measures the air pressure in the upper air chamber 100*b*.

The fluid compound is supplied to the supply tank 100 from a fluid source FS via a fluid supply line 605. As shown in FIG. 6, the fluid compound exits the fluid source FS and then passes through a compound filter 604, which removes contaminants from the compound fluid. The compound fluid is then fed to a valve 606, which controls the supply of the compound fluid to the lower fluid chamber 100*a*. According to the exemplary embodiment shown, the sensor 120 measures the height of the piston and sends an analog signal to a liner logic control 608. The liner logic control 608 converts the analog signal to a digital output that controls the valve 606, e.g., when the sensor 120 detects that the piston 106 is at or near the high fluid level location $L_H$, the liner logic control 608 turns the valve 606 off to stop the supply of the compound fluid to the lower fluid chamber 100*a*, and when the sensor 120 detects that the piston 106 is at or near the low fluid level location $L_L$, the liner logic control 608 turns the valve 606 on to supply the compound fluid to the lower fluid chamber 100*a*. This control of the air pressure and compound fluid level regulates the amount of compound fluid sprayed through the plurality of spray devices SD onto cans that are provided onto continuously rotating chuck(s) RC from at least one can source CS.

The presently disclosed dispensing system 10 offers multiple means to improve the can assembly process. For example, the division of the supply tank 100 into the lower fluid chamber 100*a* and the upper air chamber 100*b* militates against contamination of the pressurized air with the fluid compound and thus avoids the drying or curing of the fluid compound. This isolation of the pressurized air source from the fluid compound reduces the required maintenance of the dispensing system.

Additionally, the disclosed dispensing system 10 isolates the electrical sensor(s) 120 from the fluid compound. This isolation of the sensor(s) 120 prevents the fluid compound from drying or curing on the sensors and therefore reduces the required maintenance of the dispensing system.

Finally, the disclosed dispensing system 10 is suitable for use of corrosive abrasive electrically-conductive water based sealant compounds and non-corrosive, non-abrasive solvent based compounds.

The description of the present disclosure has been presented for purposes of illustration and description, but is not intended to be exhaustive or limited only to the embodiments in the form disclosed. Many modifications and variations will be apparent to those of ordinary skill in the art without departing from the scope and spirit of the invention.

Having thus described the invention of the present application in detail and by reference to embodiments thereof, it will be apparent that modifications and variations are possible without departing from the scope of the invention defined in the appended claims.

What is claimed is:

1. A dispensing system for a rotary dispensing machine having a table rotatable about a central axis of rotation, the dispensing system comprising:

a tank mounted to the table and including at least one fluid outlet port for supplying a fluid from the tank;

a fill tube extending through an upper end of the tank; and a piston located within the tank and movable along the fill tube, the piston defining an air chamber in an upper portion of the tank and a fluid chamber in a lower portion of the tank;

wherein the tank is rotatable relative to the fill tube.

2. The dispensing system as set forth in claim 1, further comprising at least one seal supported on the piston for engagement with an inner surface of a sidewall of the tank.

3. The dispensing system as set forth in claim 2, wherein the at least one seal is a resilient self-energizing seal.

4. The dispensing system as set forth in claim 3, further comprising a labyrinth seal system extending around the piston comprising upper and lower circumferential self-energizing seals formed of a resilient material for engagement with the inner surface of the sidewall, and a guide band located on the piston between the upper and lower self-energizing circumferential seals.

5. The dispensing system as set forth in claim 1, further comprising at least one seal supported on the piston for engagement with an outer surface of the fill tube.

6. The dispensing system as set forth in claim 5, wherein the at least one seal is a resilient self-energizing seal.

7. The dispensing system as set forth in claim 6, further comprising a labyrinth seal system comprising upper and lower inner self-energizing seals located in respective grooves formed in the piston and formed of a resilient material for engagement with the outer surface of the fill tube, and a guide band located between the upper and lower self-energizing inner seals.

8. The dispensing system as set forth in claim 1, wherein the fill tube is non-rotatably supported and the piston is rotatable relative to the fill tube.

9. The dispensing system as set forth in claim 1, further comprising a sensor structure for detecting a position of the piston within the tank.

10. A dispensing system for a rotary dispensing machine having a table rotatable about a central axis of rotation, the dispensing system comprising:

a rotatable tank mounted to the table and having an upper end, a lower end, and a sidewall extending between the upper and lower ends;

a fill tube extending through the upper end of the tank, the fill tube having an upper end located outside of the tank and a lower end located within the tank;

a piston located within the tank, the fill tube extending through the piston and the piston being movable relative to the fill tube and the tank, the piston defining an air chamber in an upper portion of the tank and a fluid chamber in a lower portion of the tank; and one or more outlet ports formed in the tank for dispensing a flowable material from an area defined between the piston and the lower end of the tank.

11. The dispensing system as set forth in claim 10, further comprising a non-rotatable housing located above the upper end of the tank for supporting the fill tube, the housing including an air supply port for supplying air to an area defined between the piston and the upper end of the tank.

12. The dispensing system as set forth in claim 11, further comprising a bearing positioned within the housing and around the fill tube, and an air passage defined between the fill tube and the housing for receiving air from the air supply port.

13. The dispensing system as set forth in claim 12, further comprising a seal defined between an outer surface of the fill tube and the housing.

14. The dispensing system as set forth in claim 10, further comprising an outer seal structure supported on an outer circumference of the piston, the outer seal structure having a normal position out of sealing engagement with an inner surface of the tank sidewall and having a pressure actuated self-energizing position in sealing engagement with the inner surface of the tank sidewall.

15. The dispensing system as set forth in claim 14, wherein the outer seal structure comprises:

an upper self-energizing circumferential seal located near an upper end of the piston; and a lower self-energizing circumferential seal located near a lower end of the piston.

16. The dispensing system as set forth in claim 15, wherein the upper and lower self-energizing circumferential seals comprise cup seals actuated by pressure above and below the piston biasing the circumferential seals into sealing engagement with the inner surface of the tank sidewall.

17. The dispensing system as set forth in claim 15, further comprising a guide band located on the outer circumference of the piston between the upper and lower self-energizing circumferential seals, the guide band having an outer surface in sealing relationship adjacent to the inner surface of the tank sidewall to form a labyrinth seal system with the upper and lower circumferential seals.

18. The dispensing system as set forth in claim 17, wherein the guide band comprises a magnetic material, and further comprising at least one sensor located external to the tank for sensing the magnetic material in the guide band to determine a vertical position of the piston.

19. The dispensing system as set forth in claim 10, further comprising a fluid level sensor supported with the tank for detecting a position of the piston within the tank, wherein the fluid level sensor comprises at least one of an optical sensor or a magnetic sensor.

20. The dispensing system as set forth in claim 10, further comprising an inner seal structure located in a circumferential groove formed in the piston, the inner seal structure having a normal position out of sealing engagement with an outer surface of the fill tube and having a resilient self-energizing pressure actuated position in sealing engagement with the outer surface of the fill tube.

* * * * *